US006913660B2

(12) United States Patent
Kingma et al.

(10) Patent No.: US 6,913,660 B2
(45) Date of Patent: Jul. 5, 2005

(54) DISPERSANT COMPOSITIONS COMPRISING NOVEL EMULSIFIERS FOR WATER IN OIL EMULSIONS

(75) Inventors: Arend Jouke Kingma, Ludwigshafen (DE); Arno Lange, Bad Duerkheim (DE); Hans Peter Rath, Gruenstadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/312,874

(22) PCT Filed: Jul. 5, 2001

(86) PCT No.: PCT/EP01/07722

§ 371 (c)(1),
(2), (4) Date: Jan. 2, 2003

(87) PCT Pub. No.: WO02/02485

PCT Pub. Date: Jan. 10, 2002

(65) Prior Publication Data

US 2003/0145925 A1 Aug. 7, 2003

(30) Foreign Application Priority Data

Jul. 6, 2000 (DE) ..... 100 32 829

(51) Int. Cl.[7] ..... C06B 45/00; C06B 31/28
(52) U.S. Cl. ..... 149/2; 149/46
(58) Field of Search ..... 149/46, 2

(56) References Cited

U.S. PATENT DOCUMENTS 3,649,229 A 3/1972 Otto
4,186,102 A 1/1980 Malec
4,784,706 A * 11/1988 McKenzie ..... 149/2
4,820,361 A * 4/1989 McKenzie et al. ..... 149/2
6,048,373 A 4/2000 Malfer et al.

FOREIGN PATENT DOCUMENTS

| | | |
|---|---|---|
| DE | 22 09 579 | 7/1973 |
| EP | 0 320 182 | 6/1989 |
| EP | 0 320 183 | 6/1989 |

* cited by examiner

*Primary Examiner*—Aileen Felton
(74) *Attorney, Agent, or Firm*—Oblon, Spivak, McClelland, Maier & Neustadt, P.C.

(57) ABSTRACT

The invention relates to explosive compositions comprising, in a water-in-oil emulsion as emulsifier, a Mannich adduct composed of a) a hydrocarbyl-substituted, hydroxyaromatic compound of the formula I $$(R^1)_n Ar(OH)_x \quad (I)$$

in which $R^1$ is a hydrocarbyl group selected from a straight-chain or branched $C_6$–$C_{400}$-alkyl, $C_6$–$C_{400}$-alkenyl, $C_6$–$C_{400}$-alkenyl-aryl or $C_6$–$C_{400}$-alkyl-aryl radical;
Ar is a mononuclear or polynuclear, optionally substituted aromatic ring;
n is an integral value of 1, 2 or 3; and
x is an integral value of 1 and 5;

b) formaldehyde, an oligomer or polymer thereof; and c) a nitrogen compound selected from an amine having at least one primary or secondary amino function, and ammonia.

19 Claims, No Drawings

DISPERSANT COMPOSITIONS COMPRISING NOVEL EMULSIFIERS FOR WATER IN OIL EMULSIONS

BACKGROUND OF THE INVENTION

1. Field of the Invention

The present invention relates to explosive compositions comprising specific Mannich adducts in a water-in-oil emulsion as emulsifier, and to processes for producing these compositions.

2. Description of the Background

Liquid explosives usually comprise aqueous emulsions of an inorganic oxidant such as, for example, ammonium nitrate in an organic phase which is immiscible with water. Emulsions of this type are produced in the state of the art by employing emulsifiers of various types. Thus, for example, U.S. Pat. No. 5,639,988 and U.S. Pat. No. 5,460,670 describe the use of specific hydrocarbyl polyamides as emulsifiers. U.S. Pat. No. 4,356,044 and U.S. Pat. No. 4,322,258 describe the use of sorbitan fatty acid esters, glycol esters, substituted oxazolines, alkylamines and salts and derivatives thereof as emulsifiers for this purpose. U.S. Pat. No. 3,447,978 proposes the use of various sorbitan fatty acid esters and various fatty acid glycerides as emulsifiers for liquid explosives. U.S. Pat. No. 4,141,767 discloses the use of $C_{14}$–$C_{22}$-fatty acid amines or ammonium salts as emulsifiers for explosive compositions. WO 96/41781 describes emulsifier compositions which contain as main constituent an alkylcarboxamide, alkenylcarboxamide, poly (alkyleneamine) or a (di)alkanolamine of specific structure. The emulsifier systems are suitable for producing explosive emulsions. GB-A-2 187 182 describes explosive compositions comprising a poly[alk(en)yl]succinic acid or a derivative thereof as emulsifier. WO-A-88/03522 discloses nitrogen-containing emulsifiers derived from a carboxylic acylating agent, at least one polyamide, and at least one acid or an acid-producing compound able to form a salt with the polyamine, for producing explosive compositions.

The emulsifiers mainly used at present for producing water-in-oil emulsions for liquid explosives are amide derivatives of polyisobutylene-succinic anhydride. These have the disadvantage that they can be obtained by elaborate synthesis. In addition, the synthesis gives rise to a high proportion of byproducts which vary in quantity, which makes it difficult to set a uniform quality of product, such as, for example, a constant viscosity of the emulsifier. Corresponding disadvantages emerge therefrom on production of the explosive emulsion.

SUMMARY OF THE INVENTION

It is an object of the present invention to provide improved emulsifiers for explosive emulsions which no longer have the abovementioned disadvantages.

We have found that this object is achieved by providing specific emulsifiers based on Mannich adducts.

The invention relates firstly to an explosive composition comprising, in a water-in-oil emulsion as emulsifier, a Mannich adduct composed of a) a hydrocarbyl-substituted, hydroxyaromatic compound of the formula I $$(R^1)_n Ar(OH)_x \quad (I)$$

in which $R^1$ is a hydrocarbyl group selected from a straight-chain or branched $C_6$–$C_{400}$-alkyl, $C_6$–$C_{400}$-alkenyl, $C_6$–$C_{400}$-alkyl-aryl or $C_6$–$C_{400}$-alkenyl-aryl radical;

Ar is a mononuclear or polynuclear, optionally substituted aromatic ring;

n is an integral value of 1, 2 or 3; and x is an integral value of 1 to 5;

b) formaldehyde, an oligomer or polymer thereof; and c) a nitrogen compound selected from an amine having at least one primary or secondary amino function, and ammonia.

DETAILED DESCRIPTION OF THE PREFERRED EMBODIMENT

Compositions which are preferred according to the invention are those where Ar is a mononuclear aromatic radical, and x is 1.

The nitrogen compounds used for adduct formation in the composition of the invention have, in particular, the general formula II $$HNR^2R^3 \quad (II)$$

in which $R^2$ and $R^3$ are, independently of one another, H, a $C_1$–$C_{18}$-alkyl, $C_2$–$C_{18}$-alkenyl, $C_4$–$C_{18}$-cycloalkyl, $C_1$–$C_{18}$-alkyl-aryl, $C_2$–$C_{18}$-alkenyl-aryl, hydroxy-$C_1$–$C_{18}$-alkyl, poly (oxyalkyl), polyalkylenepolyamine or polyalkyleneimine radical, or together with the nitrogen atom to which they are bonded are a heterocyclic ring.

The invention also encompasses compositions in which the emulsifier (Mannich adduct) is present as pure substance such as, for example, in isomerically pure form, or as the adduct mixture resulting from the Mannich reaction (e.g. mixture of mono- and diaminomethylated compounds).

The adduct is produced preferably by using compounds of the formula I in which $R^1$ is derived from a poly-$C_2$–$C_6$-alkene. The poly-$C_2$–$C_6$-alkene in this case is preferably composed of monomers selected from ethylene, propylene, 1-butylene, 2-butylene, i-butylene or mixtures thereof. The poly-$C_2$–$C_6$-alkene is preferably a reactive poly-$C_2$–$C_6$-alkene with a high proportion of terminal double bonds.

The Mannich adducts employed according to the invention are preferably obtained by reacting one mole equivalent of hydroxyaromatic compound of the formula I with 0.1 to 10 mole equivalents with formaldehyde, an oligomer or polymer thereof, and 0.1 to 10 mole equivalents of the nitrogen compound. Preferred Mannich adducts are obtained by reacting a poly(alkenyl)phenol with formaldehyde and a mono- or di(hydroxyalkyl)amine.

It is possible if desired for any free OH or NH groups present in the Mannich adduct to be partially or completely alkoxylated. This is achieved by conventional alkoxylation processes familiar to the skilled worker.

Explosive compositions of the invention preferably comprise a water-in-oil emulsion in which at least one emusifier as defined above is present in an amount of about 1 to 20% by weight based on the total weight of the composition.

The compositions of the invention are solid, pasty or, preferably, liquid and, in particular, pourable or pumpable, at ambient temperature.

Preferred explosive compositions comprise a) 0.5 to 20% by weight of emulsifier as defined above;

b) 2 to 20% by weight of an organic liquid which is immiscible with water and forms the oil phase;

c) 2 to 30% by weight of and/or at least one organic liquid which is miscible with water;

d) 40 to 90% by weight of an inorganic oxidant;

e) 0 to 25% by weight of other conventional explosive additives such as density-adjusting agents, combustible inorganic or organic solids.

The invention further relates to the use of a Mannich adduct as defined above as emulsifier for water-in-oil or oil-in-water emulsions from explosives; especially liquid explosives.

The invention further relates to a process for producing an explosive composition of the invention, which comprises dissolving the Mannich adduct in an organic liquid forming the oil phase, heating the organic solution where appropriate, and emulsifying therein an aqueous phase which comprises an inorganic oxidant and which has been heated where appropriate.

The starting materials employed to produce the Mannich adducts used according to the invention (aromatic compound of the formula I, formaldehyde and nitrogen compound) are generally known compounds or compounds which can be produced by the skilled worker without undue burden in a known manner.

Hydrocarbyl-substituted Hydroxyaromatic Compounds of the Formula I:

In the compounds of the general formula I, $R^1$ is preferably straight-chain or branched alkyl, alkenyl, alkylaryl or alkenylaryl radicals, where the alkyl or alkenyl moiety has a number average molecular weight $M_N$ of 200 or more, in particular 1,000 or more. The upper limit of $M_N$ is about 10,000, preferably about 5,000. The alkenyl group may have one or more such as, for example, 1 to 20, preferably isolated, double bonds.

The aryl group of $R^1$ is preferably derived from mononuclear or binuclear fused or unfused 4- to 7-membered, in particular 6-membered aromatic or heteroaromatic groups such as phenyl, pyridyl, naphthyl and biphenylyl.

The hydroxyaromatic group —$Ar(OH)_x$ in compounds of the formula I is derived from aromatic compounds which are hydroxylated one or more times, in particular one to five times, preferably once or twice, and which have one or more, in particular one to three, fused or unfused 4- to 7-membered, in particular 6-membered, aromatic or heteroaromatic rings. The hydroxylated aromatic compound may, where appropriate, be substituted one or more times, in particular once or twice. Particularly suitable substituted aromatic compounds are those substituted once in the position ortho to the hydroxyl group. Examples of suitable substituents are $C_1$–$C_{20}$-alkyl substituents or $C_1$–$C_{20}$-alkoxy substituents. Particularly suitable substituents are $C_1$–$C_7$-alkyl radicals such as methyl, ethyl, n-propyl, isopropyl, n-butyl, sec-butyl, tert-butyl, n-pentyl, n-hexyl and n-heptyl.

Nonlimiting examples of such hydroxylated aromatic compounds are mononuclear aromatic compounds such as phenol, 2-ethylphenol, catechol, resorcinol, hydroquinone, o-, m- or p-cresol, binuclear aromatic compounds such as alpha- or beta-naphthol, or trinuclear compounds such as anthranol.

The hydroxyaromatic compounds of the general formula I employed according to the invention can be prepared, for example, as described in EP-B-0 628 022, U.S. Pat. No. 5,300,701; thesis of D. Jamois, "Synthese d'oligoisobutenes telecheliques-phenol", 1988, Paris; or Kennedy et al., Polym. Bull. 1970, 8, 563. This is done by reacting a hydroxyaromatic compound in a manner known per se with a polyalkene which has at least one C=C double bond to introduce the hydrocarbyl radical $R^1$ (hydrocarbylation or alkylation).

The compounds of the general formula I can also be prepared in analogy to the processes described in DE-A-199 48 114 and DE-A-199 48 111, which are incorporated herein by reference.

In the hydrocarbylation, the hydroxyaromatic compound is reacted with 0.1 to 10, such as, for example, 0.1 to 5, mole equivalents of polyalkene.

If the hydroxyaromatic compound is employed in excess, unreacted aromatic compound can be removed by extraction with solvents, preferably polar solvents, such as water or $C_1$–$C_6$-alkanols or mixtures thereof, by stripping, i.e. by passing steam through or, where appropriate, heating of gases, e.g. nitrogen, or by distillation.

The hydrocarbylation of the hydroxyaromatic compound is preferably carried out at a temperature of about 50° C. to −40° C. Temperatures particularly suitable for the hydrocarbylation are in the range from −10 to −30° C., in particular in the range from −5 to +25° C. and particularly preferably from 0 to +20° C.

Suitable hydrocarbylation catalysts are known to the skilled worker. Suitable examples are protic acids such as sulfuric acid, phosphoric acid and organic sulfonic acids, e.g. trifluoromethanesulfonic acid, Lewis acids such as aluminum trihalides, e.g. aluminum trichloride or aluminum tribromide, boron trihalides, e.g. boron trifluoride and boron trichloride, in halides, e.g. tin tetrachloride titanium halides, e.g. titanium tetrabromide and titanium tetrachloride; and iron halides, e.g. iron trichloride and iron tribromide. Preferred adducts are those of boron trihalides, in particular boron trifluoride, with electron donors such as alcohols, in particular $C_1$–$C_6$-alkanols or phenols, or ethers. Boron trifluoride etherate or boron trifluoride phenolate is particularly preferred.

The hydrocarbylation is preferred carried out in a liquid medium. For this purpose, the hydroxyaromatic compound is preferably dissolved in one of the reactants and/or a solvent, where appropriate with heating. In a preferred embodiment, therefore, the hydrocarbylation is carried out in such a way that the hydroxyaromatic compound is initially melted with input of heat and then mixed with a suitable solvent and/or the alkylation catalyst, in particular the boron trihalide adduct. The liquid mixture is then brought to a suitable reaction temperature. In another preferred embodiment, the hydroxyaromatic compound is first melted and mixed with the polyalkene and, where appropriate, a suitable solvent. The liquid mixture obtained in this way can be brought to a suitable reaction temperature and then mixed with the alkylation catalyst.

Examples of solvents suitable for carrying out this reaction are hydrocarbons, preferably pentane, hexane and heptane, in particular hexane, hydrocarbon mixtures, e.g. petroleum ethers with boiling ranges between 35 and 100° C., dialkyl ethers, in particular diethyl ethers, and halogenated hydrocarbons such as dichloromethane or trichloromethane, and mixtures of the aforementioned solvents.

The reaction is preferably initiated by adding catalyst or one of the two reactants. The component initiating the reaction is preferably added over a period of from 5 to 300 minutes, during which the temperature of the reaction mixture advantageous does not exceed the temperature ranges indicated above. After the addition is complete, the reaction mixture is preferably left to react for 30 minutes to 24 hours, in particular 60 minutes to 16 hours, at a temperature below 30° C.

In particularly preferred hydroxyaromatic compounds of the formula I, $R^1$ is derived from polyisobutenes. Particularly suitable polyisobutenes are so-called "highly reactive" polyisobutenes which have a high content of terminal ethylene double bonds. Terminal double bonds are α-olefinic double bonds of the type

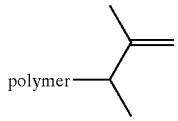

and β-olefinic double bonds of the type

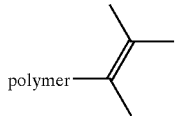

which are also designated as vinylidene double bonds.

Suitable highly reactive polyisobutenes are, for example, polyisobutenes having a content of vinylidene double bonds greater than 70 mol %, in particular greater than 80 mol % or greater than 85 mol %. Particularly preferred polyisobutenes have uniform polymer structures. Uniform polymer structures are shown in particular by polyisobutenes which are at least 85% by weight, preferably at least 90% by weight and, particularly preferably, at least 95% by weight composed of isobutene units. Such highly reactive polyisobutenes preferably have a number average molecular weight in the abovementioned range. In addition, the highly reactive polyisobutenes can have a polydispersity in the range of about 1.05 to 7, in particular of about 1.1 to 2.5, as, for example, of less than 1.9 or less than 1.5. Polydispersity means the quotient formed by dividing the weight average molecular weight $M_W$ by the number average molecular weight $M_N$.

Examples of particularly suitable highly reactive polyisobutenes are the Glissopal® brands of BASF AG, in particular Glissopal 1000 ($M_N$=1,000), Glissopal V 33 ($M_N$=550) and Glissopal 2300 ($M_N$=2,300) and mixtures thereof. Other number average molecular weights can be adjusted in a way which is known in principle by mixing polyisobutenes of different number average molecular weights or by extractive concentration of polyisobutenes of particular molecular weight ranges.

The organic phase of the reaction mixture obtained in the hydrocarbylation described above is then separated off, washed with water where appropriate, and dried, and excess hydroxyaromatic compound is removed where appropriate. The reaction product obtained in this way, which may contain a mixture of compounds of the formula I, is then employed in the Mannich reaction.

Formaldehyde component:

Suitable aldehydes are, in particular formaldehyde, formalin solutions, formaldehyde oligomers, e.g. trioxane, or polymers of formaldehyde, such as paraformaldehyde. Paraformaldehyde is preferably employed. Formalin solution is particularly easy to handle. It is, of course, also possible to employ gaseous formaldehyde.

Nitrogen compound:

Amines suitable for the Mannich adduct formation according to the invention are, in particular, compounds of the formula II, i.e. $HNR^2R^3$.

$R^2$ and $R^3$ therein may, independently of one another, be:

a) H;

b) a $C_1$–$C_{18}$-alkyl radical; examples which should be mentioned of suitable alkyl radicals are straight-chain or branched radicals having 1 to 18 C atoms, such as methyl, ethyl, i- or n-propyl, n-, i-, sec- or tert-butyl, n- or i-pentyl; also n-hexyl, n-heptyl, n-octyl, n-nonyl, n-decyl, n-undecyl, n-tridecyl, n-tetradecyl, n-pentadecyl and n-hexadecyl and n-octadecyl, and the singly or multiply branched analogs thereof; and corresponding radicals in which the carbon chain has one or more ether bridges;

c) a $C_2$–$C_{18}$-alkenyl radical; examples which should be mentioned of suitable alkenyl radicals are the monounsaturated or polyunsaturated, preferably monounsaturated or diunsaturated analogs of the abovementioned alkyl radicals having 2 to 18 carbon atoms, it being possible for the double bond to be in any position in the carbon chain;

d) a $C_4$–$C_{18}$-cycloalkyl radical; examples which should be mentioned are cyclobutyl, cyclopentyl and cyclohexyl, and the analogs thereof substituted by 1 to 3 $C_1$–$C_4$-alkyl radicals; the $C_1$–$C_4$-alkyl radicals being selected, for example, from methyl, ethyl, i- or n-propyl, n-, i-, sec- or tert-butyl;

e) a $C_1$–$C_{18}$-alkyl radical; where the $C_1$–$C_{18}$-alkyl group is as defined above, and the aryl group has the same meanings as the aryl group of $R^1$ defined above;

f) a $C_2$–$C_{18}$-alkenyl-aryl radikal; where the $C_2$–$C_{18}$-alkenyl group is as defined above, and the aryl group has the same meanings as the aryl group of $R^1$ defined above;

g) a hydroxy-$C_1$–$C_{18}$-alkyl radical; where this corresponds to the analogs of the above $C_1$–$C_{18}$-alkyl radicals which are hydroxylated one or more times, preferably once, in particular terminally once; such as, for example, 2-hydroxyethyl and 3-hydroxypropyl;

h) an optionally hydroxylated poly(oxyalkyl)radical which is obtained by alkoxylation of the N atom with 2 to 10 $C_1$–$C_4$-alkoxy groups, it being possible for some carbon atoms where appropriate to carry other hydroxyl groups. Preferred alkoxy groups comprise methoxy, ethoxy and n-propoxy groups;

i) a polyalkylenepolyamine radical of the formula $$Z—NH—(C_1–C_6\text{-alkylene-NH})_m—C_1–C_6\text{-alkylene},$$

in which m has an integral value from 0 to 5, Z is H or $C_1$–$C_6$-alkyl, and $C_1$–$C_6$-alkyl means radicals such as methyl, ethyl, i- or n-propyl, n-, i-, sec- or tert-butyl, n- or i-pentyl; also n-hexyl; and $C_1$–$C_6$-alkylene means the corresponding bridged analogs of these radicals;

k) a polyalkyleneimine radical composed of 1 to 10 $C_1$–$C_4$-alkyleneimine groups, in particular ethyleneimine groups;

l) or together with the nitrogen atom or which they are bonded are an optionally substituted 5- to 7-membered heterocyclic ring which is optionally substituted by one to three $C_1$–$C_4$-alkyl radicals and optionally has another ring hetero atoms such as O or N.

Examples of suitable compounds of the formula $HNR^2R^3$ are:

primary amines such as methylamine, ethylamine, n-propylamine, isopropylamine, n-butylamine, isobutylamine, sec-butylamine, tert-butylamine, pentylamine, hexylamine, cyclopentylamine and cyclohexylamine; and primary amines of the formula $CH_3—O—C_2H_4—NH_2$, $C_2H_5—O—C_2H_4—NH_2$, $CH_3—O—C_3H_6—NH_2$, $C_2H_5—O—C_3H_6—NH_2$, $n—C_4H_9—O—C_4H_8—NH_2$, $HO—C_2H_4—NH_2$, $HO—C_3H_6—NH_2$ and $HO—C_4H_8—NH_2$;

secondary amines such as, for example dimethylamine, diethylamine, methylethylamine, di-n-propylamine, diisopropylamine, diisobutylamine, di-sec-butylamine, di-tert-butylamine, dipentylamine, dihexylamine, dicyclopentylamine, dicyclohexylamine and diphenylamine; and secondary amines of the formula $(CH_3—O—C_2H_4)_2NH$, $(C_2H_5—O—C_2H_4)_2NH$, $(CH_3—O—C_3H_6)_2NH$, $(C_2H_5O—C_3H_6)_2NH$, $(n—C_4H_9—O—C_4H_8)_2NH$, $(HO—C_2H_4)_2NH$, $(HO—C_3H_6)_2NH$ and $(HO—C_4H_8)_2NH$;

heterocyclic amines such as pyrrolidine, piperidine, morpholine and piperazine, and their substituted derivatives such as $N—C_1–C_6$-alkylpiperazines and dimethylmorpholine.

polyamines such as, for example $C_1–C_4$-alkylenediamines, di-$C_1–C_4$-alkylenetriamines, tri-$C_1–C_4$-alkylenetetramines and higher analogs;

polyethyleneimines, preferably oligoethyleneimines consisting of 1 to 10, preferably 2 to 6, ethyleneimine units. Particular examples of suitable polyamines and polyimines are n-propylenediamine, 1,4-butanediamine, 1,6-hexanediamine, diethylenetriamine, triethylenetramine and polyethylene-imines, and their alkylation products such as, for example, 3-(dimethylamino)-n-propylamine, N,N-dimethylethylenediamine, N,N-diethylethylenediamine and N,N,N',N'-tetramethyldiethylenetriamine. Ethylenediamine is likewise suitable.

Preparation of the Mannich adducts:

The Mannich adducts employed according to the invention are prepared in a manner known per se as described, for example, in DE-A-2 209 579, U.S. Pat. No. 3,649,229 or U.S. Pat. No. 4,231,759, which are incorporated herein by reference. The reaction can also be carried out in analogy to the process described in DE-A-199 48 114 and DE-A-199 48 111, which are likewise incorporated herein by reference.

The Mannich reaction is preferably carried out in such a way that the aldehyde, amine and aromatic reactants are combined at a temperature in the range between 10 and 50° C., mixed in this temperature range where appropriate for 10 to 300 minutes, and then brought to the temperature necessary for removal of the water of reaction by distillation over the course of 5 to 180 minutes, preferably 10 to 120 minutes. The overall reaction time for the adduct formation is generally between 10 minutes and 24 hours.

Normally 0.1 to 10.0 mol, preferably 0.5 to 2.0 mol, of aldehyde and 0.1 to 10.0 mol, preferably 0.5 to 2.0 mol of amine, based on 1 mol of hydrocarbyl-substituted aromatic compound of the formula I, are employed.

For example, the aldehyde, amine and aromatic reactants are employed in an approximately equimolar ratio or a ratio of about 2:2:1. This normally leads to a substantially uniform product picture with a high content of amine-containing compounds. In this connection, an approximately equimolar ratio of the reactants leads to the preferred formation of monoaminomethylated compounds, and a ratio of the reactants of about 2:2:1 leads to the preferred formation of bisaminomethylated compounds.

Suitable temperatures for the Mannich reaction are preferably in the range from 10 to 200° C., in particular in the range from 20 to 180° C.

Water is produced in the reaction to form the Mannich adduct. This water is normally removed from the reaction mixture. The removal of the water of reaction can take place during the reaction, at the end of the reaction time or after the reaction is complete, for example by distillation. The water of reaction can advantageously be removed by heating the reaction mixture in the presence of entrainers. Examples of suitable entrainers are organic solvents which form an azeotrope with water and/or have a boiling point above the boiling point water.

Particularly suitable entrainers are benzene and alkylaromatic compounds, in particular toluene, xylenes and mixtures of alkylaromatic compounds with other (high-boiling) hydrocarbons. The water of reaction is normally removed at a temperature which approximately corresponds to the boiling point of the entrainer or the azeotrope of water and entrainer.

Suitable temperatures for removing the water of reaction are therefore in the range from 75 to 200° C. under atmospheric pressure. If the water of reaction is removed under reduced pressure, the temperatures should be reduced in accordance with the reduction in the boiling points.

The Mannich adducts prepared in this way have excellent emulsifying properties and are particularly suitable for producing explosive composition of the invention. The production of such explosives is described in detail below.

Explosive compositions:

The compositions of the invention contain an oil-in-water or, preferably a water-in-oil emulsion which is in the solid, pasty or, preferably liquid state and is produced using at least one of the emulsifiers described above.

The organic liquid which is immiscible with water and forms the oil phase in the explosive compositions of the invention is present in an amount of about 2–20% by weight, preferably about 3–12% by weight, in particular about 4–8% by weight, based on the total weight of the composition. The amount actually employed varies depending on the organic liquid(s) used in each case. The organic liquid may be alphatic, cycloaliphatic and/or aromatic and be saturated or unsaturated in nature. The organic liquid used is preferably liquid during the production of the formation. Preferred liquids comprise tall oil, mineral oils, waxes, liquid paraffins, benzene, toluene, xylene, mixtures of liquid hydrocarbons which are known under the collective term of crude oil distillates, such as, for example, gasoline, kerosine and diesel fuel, and vegetable oils such as corn oil, cottonseed oil, peanut oil and soybean oil. Particularly preferred organic liquids are mineral oil, paraffin waxes, microcrystalline waxes and mixtures thereof. Aliphatic and aromatic nitrogen-containing compounds can likewise be used.

Other conventional solid or liquid combustible or oxidizable, inorganic or organic substances or mixtures thereof may be present in the compositions of the invention in an amount of up to 15% by weight, such as, for example, about 1 to 12% by weight. Examples thereof are: aluminum particles, magnesium particles, carbon-containing materials such as, for example, soot, vegetable granules such as, for example wheat granules, and sulfur.

The compositions of the invention contain as inorganic oxidant, which is a constituent of the discontinuous aqueous phase, in an amount of about 40 to 95% by weight, such as, for example, about 50 to 90% by weight, based on the total weight of the composition, at least one inorganic salt dissolved in water and/or in an organic liquid which is miscible with water and which is present in an amount of about 2 to about 30% by weight, based on the total weight of the compositions. Suitable salts are alkali metal, alkaline earth metal or ammonium nitrates, chlorates or perchlorates. Examples of suitable oxidants are sodium nitrate, sodium chlorate, sodium perchlorate, calcium nitrate, calcium chlorate, calcium perchlorate, potassium nitrate, potassium chlorate, potassium perchlorate, ammonium chlorate, ammonium perchlorate, lithium nitrate, lithium chlorate, lithium perchlorate, magnesium nitrate, magnesium chlorate, magnesium perchlorate, aluminum nitrate, aluminum chlorate, barium nitrate, barium chlorate, barium perchlorate, zinc nitrate, zinc chlorate, zinc perchlorate, ethylenediamine dichlorate and ethylenediamine diperchlorate. The preferred oxidant is ammonium, sodium and/or calcium nitrate. About 10–65% by weight of the total oxidant may be present in crystalline or particular form.

Water is generally employed in an amount of about 2–30% by weight based on the total weight of the composition. Water can also be used in combination with an organic liquid which is miscible with water, in order where appropriate to improve the solubility of the salts used or in order to alter the crystallization temperature of the salts. Examples of organic liquids which are miscible with water are alcohols such as methyl alcohol, glycols such as ethylene glycol, amides such as formamide, and analogous nitrogen-containing liquids.

The emulsifier preferably used for dispersing the aqueous phase is about 0.5 to 20% by weight of a Mannich adduct of the invention or a mixture of such adducts. Other conventional emulsifying additives can be used where appropriate. As nonlimiting examples thereof, mention may be made of the compounds described in the prior art cited at the outset, in particular the PIBSA derivatives or sorbitan fatty esters mentioned. It is also possible to use other conventional emulsifiers known from the prior art, as described, for example, in Ullmann's Encyclopedia of Industrial Chemistry, 5th edition, volume A9, pp. 318 to 318, in small amounts such as, for example, 0.1 to 5% by weight based on the total weight of the composition.

Other conventional additives which can be employed are agents to adjust the density of the composition. The density of the composition of the invention is in the range from about 0.5 to about 1.5 g/ccm. Examples of agents suitable for adjusting the density are glass beads, plastic beads, Perlite or foaming or gas-forming agents.

The explosive compositions of the invention are formulated in a conventional way. Normally, first the oxidant is dissolved in water or an aqueous solution at a temperature in the region of, for example, about 20–90° C. The aqueous solution is then added to a solution of the emulsifier and of the organic liquid which is immiscible with water. For this purpose, the organic solution is likewise heated to a temperature similar to that of the aqueous solution. The resulting mixture is stirred to produce a uniform water-in-oil emulsion. Other solid constituents which are present where appropriate are subsequently stirred into the emulsion.

The present invention is now explained in detail by means of the following exemplary embodiments.

EXAMPLES

Example 1

Production of a Polyisobutenephenol by Alkylation of Phenol with a Polyisobutene with $M_N$=200

94 g of phenol were melted at 40 to 45° C. under a nitrogen atmosphere in a 2 l four-neck flask. 106 g of $BF_3$/diethyl ether adduct were added dropwise, and the mixture was cooled to 10° C. 500 g of polyisobutene with $M_N$=200 and an isopropenyl (α-olefinic end group) content of 85%, dissolved in 150 ml of hexane, were added dropwise at 15 to 20° C. over the course of 90 minutes. The mixture was allowed to warm to room temperature over the course of 1 hour and was then stirred overnight. The reaction was stopped by adding 200 ml of 25% strength ammonia solution. The organic phase was separated off and then washed eight times with 500 ml of water and dried over over $Na_2SO_4$, and the solvent and small amount of phenol were removed in vacuo. Yield: 330 g of oil (polyisobutenephenol).

$^1$H-NMR shows a mixture of 15 mol % of 2,4,6-triisobutenylphenol, 65 mol % of 2,4-diisobutenylphenol and 20 mol % of monoisobutenylphenols.

Example 2

Preparation of a Polyisobutenephenol by Alkylation of Phenol with a Polyisobutene with $M_N$=550.

404.3 g of phenol were melted at 40 to 45° C. under a nitrogen atmosphere in a 4 l four-neck flask. 191 g of $BF_3$/diethyl ether adduct were added dropwise, and the mixture was cooled to 10° C. 1,100 g of polyisobutene with $M_N$=550 and an dimethylvinylidene content of 85%, dissolved in 1,000 ml of hexane, were added dropwise at 5 to 10° C. over the course of 150 minutes. The mixture was allowed to warm to room temperature over the course of 4 hours and was stirred overnight. The reaction was stopped by adding 1200 ml of 25% strength ammonia solution. The organic phase was separated off and then washed eight times with 500 ml of water and dried over $NaSO_4$, and the solvent and small amounts of phenol were removed in vacuo. Yield: 1,236 g of oil (4-polyisobutenephenol).

NMR: 7.2 ppm (doublet, 2H), 6.7 ppm (doublet, 2H), 4.8 ppm (singlet, 1H), 1.75 ppm (singlet 2H), 1.5–0.5 ppm (singlets, 78H).

This corresponds to an Mw of 550 for the alkyl radical. There are small signals in the 7.1–6.75 ppm signal region and these may represent 5–10% of 2- or 2,4-substituted phenol.

Example 3

Preparation of a Polyisobutenephenol by Alkylation of Phenol with a Polyisobutene with $M_N$=1,000.

203.1 g of phenol are melted at 40–45° C. under nitrogen in a 4 l four-neck flask. 95.5 g of $BF_3$/diethyl ether adduct are added dropwise, and the mixture was cooled to 20–25° C. 998 g of polyisobutene with $M_N$=1,000 and an isopropenyl content (β-olefinic end group) of 85%, dissolved in 1,800 ml of hexane, are added dropwise at 20–25° C. over 3 h. The mixture is then stirred overnight. The reaction is stopped with 500 ml of 25% strength ammonia solution. The organic phase is washed seven times with 500 ml of water, dried over $Na_2SO_4$ and concentrated in a rotary evaporator. Yield: 1,060 g of oil ("PIB-phenol").

NMR: 7.2 ppm (doublet, 2H), 6.7 ppm (doublet, 2H), 4.8 ppm (singlet, broad 1H), 1.75 ppm (singlet, 2H), 1.5–0.5 ppm (singlets, 165H).

This corresponds to an Mw of 1,150 for the alkyl radical. There are small signals in the 7.1–6.75 signal region and these may represent 5–10% of 2,4-substituted phenol, which is consistent with the slightly increased molecular weight found.

Example 4

Preparation of Various Mannich Adducts of 4-polyisobutenephenols a) 108 g of PIB-phenol from Example 2 are introduced into 85 mol of toluene in a 0.5 l four-neck flask with water trap. 35 g of diethanolamine and 10 g of paraformaldehyde are added, and water is removed azeotropically for 2 h. A further 17 g of diethanolamine and 5.2 g of paraformaldehyde are then added, and water is removed azeotropically for 2 h. The solution is filtered and concentrated in a rotary evaporator. Yield: 130 g of 2,6-di(N,N-dihydroxyethylaminomethyl)polyisobutene-phenol as oil. According to NMR, the oil contains 10–15% of 2-(N,N-dihydroxyethylaminomethyl)-4-polyisobutenephenol;

b) 110 g of PIB-phenol from Example 3 are introduced into 200 ml of toluene in a 0.5 l four-neck flask with water tap. 12 g of diethanolamine and 3.6 g of paraformaldehyde are added, and water is removed azeotropically for 2 h. The solution is filtered and concentrated in a rotary evaporator. Yield: 115 g of 2-(N,N-dihydroxyethylaminomethyl)-4-polyisobutene-phenol as oil. According to NMR, the oil contains 20–30% of 4-polyisobutenephenol.

c) 107 g of PIB-phenol from Example 3 are introduced into 200 ml of toluene in a 0.5 l four-neck flask with water trap. 29 g of diethanolamine and 9 g of paraformaldehyde are added, and water is removed azeotropically for 2 h. The solution is filtered and concentrated in a rotary evaporator. Yield: 118 g of oil. According to NMR a 1:1 mixture (mol:mol) of 2-(N,N-dihydroxyethylaminomethyl)-4-polyisobutenephenol and 2,6-di(N,N-dihydroxyethylaminomethyl)-4-polyisobutenephenol.

Example 5

Production of a Liquid Explosive Emulsion 30 parts of an emulsifier prepared as in Example 4 are dissolved in 50 parts of mineral oil and heated to 70° C. 1,100 parts of heated ammonium nitrate solution (80% in water, 80° C.) are added to this vigorously stirred solution. The emulsion obtained in this way is cooled to room temperature. The resulting product is transparent and shows no tendency to separate or crystallize even after storage for 2 months. A sample of the emulsion is covered with water and shows no breaking of the emulsion even after several weeks.

We claim:

1. A explosive composition, comprising: in a water-in-oil emulsion as emulsifier, a Mannich adduct that is prepared by reacting:

a) a hydrocarbyl-substituted, hydroxyaromatic compound of formula I $$(R^1)_n Ar(OH)_x \quad (I)$$

in which $R^1$ is a hydrocarbyl group selected from a straight-chain or branched $C_6$–$C_{400}$-alkyl, $C_6$–$C_{400}$-alkenyl, $C_6$–$C_{400}$-alkenyl-aryl or $C_6$–$C_{400}$-alkyl-aryl radical;

Ar is a mononuclear or polynuclear, optionally substituted, aromatic ring;

n is an integral value of 1, 2 or 3; and x is an integral value of 1 to 5;

b) formaldehyde, an oligomer or polymer thereof; and c) a nitrogen compound of formula II $$HNR^2R^3 \quad (II)$$

in which $R^2$ and $R^3$ are, independently of one another, H, a $C_1$–$C_{18}$-alkyl, $C_1$–$C_{18}$-alkenyl, $C_4$–$C_{18}$-cycloalkyl, C–$C_{18}$alkyl-aryl, $C_2$–$C_{18}$-alkenyl-aryl, hydroxyl-$C_1$–$C_{18}$-alkyl or poly(oxyalkyl) radical, or together with the nitrogen atom to which they are bonded are a heterocyclic ring.

2. The composition as claimed in claim 1, wherein Ar is a mononuclear radical and x is 1.

3. The composition as claimed in claim 1, wherein the emulsifier is present in the form of pure substance or as a mixture resulting from the Mannich reaction.

4. The composition as claimed in claim 1, wherein $R^1$ is derived from a poly-$C_2$–$C_6$-alkene.

5. The composition as claimed in claim 4, wherein the poly-$C_2$–$C_6$-alkene is comprised of monomers selected from ethylene, propylene, 1-butylene, i-butylene, 2-butylene or mixtures thereof.

6. The composition as claimed in claim 5, wherein the poly-$C_2$–$C_6$-alkene is a reactive poly-$C_2$–$C_6$-alkene with a high proportion of terminal double bonds.

7. The composition as claimed in claim 6, wherein the reactive polyalkene is polyisobutene.

8. The composition as claimed in claim 7, wherein the reactive polyisobutene has at least one of the following features:

a) a proportion of vinylidene double bonds of at least 70 mol %, that is referred to as the polyisobutene moiety, b) a uniform polyisobutene polymeric backbone of at least 85% by weight isobutene units;

c) a number average molecular weight Mn of about 200 to 10000; and/or d) a polydispersity of about 1.05 to 7.

9. The composition as claimed in claim 1, wherein the Mannich adduct is obtained by reacting one mole equivalent of hydroxyaromatic compound of the formula I with 0.1 to 10 mole equivalents of formaldehyde, an oligomer or polymer thereof and 0.1 to 10 mole equivalents of the nitrogen compound.

10. The composition as claimed in claim 1, wherein the Mannich adduct is obtained by reacting a poly(alkenyl) phenol with formaldehyde and a mono- or di(hydroxyalkyl) amine.

11. The composition as claimed in claim 1, wherein any free OH or NH groups present in the Mannich adduct are partially or completely alkoxylated.

12. The composition as claimed in claim 1, which comprises a water-in-oil emulsion in which the emulsifier as defined in claim 1 is present in an amount of about 1 to 20% by weight based on the total weight of the composition.

13. The composition as claimed in claim 1, which comprises:

a) 0.5 to 20% by weight of emulsifier;

b) 2 to 20% by weight of an organic liquid which is immiscible with water and forms the oil phase;

c) 2 to 30% by weight of water and/or at least one organic liquid which is miscible with water;

d) 40 to 90% by weight of an inorganic oxidant; and e) 0 to 25% by weight of other conventional additives.

14. The composition as claimed in claim 1, wherein the oil of said oil-in-water emulsion is an oil selected from the group consisting of tall oil, mineral oil, a wax, liquid paraffins, benzene, toluene, xylene, crude oil distillates and vegetable oils.

15. The composition as claimed in claim 1, which further comprises an oxidant that is selected from the group consisting of the alkali metal, alkaline earth metal and ammonium nitrate, chlorate and perchlorate salts.

16. The composition as claimed in claim 1, which further comprises an oxidant which is present in the composition in an amount ranging from 40 to 95% by wt of the total weight of the composition.

17. The composition as claimed in claim 1, wherein the oil phase of said oil-in-water emulsion is present in the composition in an amount ranging from about 2 to 20% by weight based on the total weight of the composition.

18. The composition as claimed in claim 17, wherein the oil phase of said oil-in-water emulsion is present in the composition in an amount ranging from about 3 to 12% by weight based on the total weight of the composition.

19. A method of preparing an explosive composition, comprising:

dissolving the Mannich adduct as defined in claim 1 in an organic liquid that forms the oil phase of the explosive composition;

heating the organic solution where approximate; and emulsifying therein an aqueous phase which has been heated where appropriate and which comprises an inorganic oxidant.

* * * * *